US008401419B2

(12) United States Patent
Koshimura et al.

(10) Patent No.: US 8,401,419 B2
(45) Date of Patent: Mar. 19, 2013

(54) IMAGE FORMING APPARATUS

(75) Inventors: Yasushi Koshimura, Hino (JP); Daiki Yamanaka, Sagamihara (JP)

(73) Assignee: Konica Minolta Business Technologies, Inc. (JP)

( * ) Notice: Subject to any disclaimer, the term of this patent is extended or adjusted under 35 U.S.C. 154(b) by 336 days.

(21) Appl. No.: 12/947,682

(22) Filed: Nov. 16, 2010

(65) Prior Publication Data

US 2011/0129249 A1 Jun. 2, 2011

(30) Foreign Application Priority Data

Nov. 30, 2009 (JP) ..... 2009-271193

(51) Int. Cl.
*G03G 21/20* (2006.01)
*G03G 21/00* (2006.01)
*G03G 15/095* (2006.01)

(52) U.S. Cl. ..... 399/92; 399/99; 399/264

(58) Field of Classification Search ..... 399/92, 399/93, 99, 264, 351, 360
See application file for complete search history.

(56) References Cited

U.S. PATENT DOCUMENTS

| | | | | |
|---|---|---|---|---|
| 6,480,685 | B2 * | 11/2002 | Jones et al. | 399/98 |
| 7,043,172 | B2 * | 5/2006 | Koshimura et al. | 399/99 |
| 7,555,246 | B2 * | 6/2009 | Zirilli | 399/253 |
| 7,587,154 | B2 * | 9/2009 | Sakai et al. | 399/92 |
| 2007/0065171 | A1 * | 3/2007 | Koshimura et al. | 399/99 |

FOREIGN PATENT DOCUMENTS

| | | |
|---|---|---|
| JP | 08-220882 | 8/1996 |
| JP | 2001-255797 | 9/2001 |
| JP | 2007-086436 | 4/2007 |

* cited by examiner

*Primary Examiner* — David Gray
*Assistant Examiner* — Gregory H Curran
(74) *Attorney, Agent, or Firm* — Squire Sanders (US) LLP

(57) ABSTRACT

An image forming apparatus, in which a toner collection section is disposed in an air pathway between a ventilation duct and suction blower, and the toner collection section and a recovery container are connected via an opening and closing device, has a control device to control the opening and closing device to close the opening and closing device when the suction blower is suctioning air and to open the opening and closing device so that the recovery container recovers the toner collected by the toner collection section after the suction blower is stopped.

10 Claims, 4 Drawing Sheets

IMAGE FORMING APPARATUS

This application is based on Japanese Patent Application No. 2009-271193 filed on Nov. 30, 2009, in Japanese Patent Office, the entire content of which is hereby incorporated by reference.

TECHNICAL FIELD

The present invention relates to an image forming apparatus of electrophotographic method and in particular to an image forming apparatus having a developer suction section to suction and collect developer wafting at the time of developing.

BACKGROUND

In the image forming apparatus employing electrophotographic method, there is a problem of griming an image that toner from a developing device which wafts, grimes and accumulates inside the apparatus, spills on a transfer sheet and grimes an image. In particular, in case of an image forming apparatus having a long print durability to continue printing for a long time without stopping the apparatus, it is a big problem.

To cope with the above problem, in Patent Document 1: Unexamined Japanese Patent Application Publication No. H08-220882, there is suggested a method using so called a developer suction to suction the wafting toner at a periphery of the developing device from a suction opening of a ventilation duct. In this method, the wafting toner is suctioned and collected by a filter so to prevent image forming processing members (constituent element) and transfer members (sheet) from griming.

However, in the method using developer suction described in the Patent Document 1, there is a problem that the filter has to be replaced frequently since the filter collects the wafting toner.

Then, in Patent document 2: Unexamined Japanese Patent Application Publication No. 2007-86436, there is suggested another method to collect the wafting toner by disposing a separate collecting member from suctioning the wafting toner until collecting the wafting toner by the filter. In the method of the Patent Document 2, a baffle member is disposed on the way in the ventilation duct before the suctioned wafting toner reaches to the filter so that a part of the wafting toner is collected by the baffle member. In the Patent Document 3: Unexamined Japanese Patent Application Publication No. 2001-255797, there is suggested a cyclone separation method to collect the toner on the way in the ventilation duct before collecting the toner by the filter. As above, by collecting the toner on the way in the ventilation duct, an amount of the toner reaches to the filter is reduced and replacing of the filter is decreases in the frequency.

Patent Document 1: Unexamined Japanese Patent Application Publication No. H08-220882

Patent Document 2: Unexamined Japanese Patent Application Publication No. 2007-86436

Patent Document 3: Unexamined Japanese Patent Application Publication No. 2001-255797

In the methods of the Patent Documents 2 and 3, the toner collected on the way in the ventilation duct has to be recovered. In the Patent Document 2, though the buffer member is replaced as a collecting box, replacing of the collecting box increases in the frequency. In the Patent Document 3, since an exclusive toner recovery container is disposed, the size of the apparatus increases and the recovery container has to be stored as a maintenance parts which results in cost increase.

SUMMARY

The present invention has one aspect to solve the above problems and an image forming apparatus reflecting the aspect of the present invention is a compact image forming apparatus using a method of developer suction, requiring no recovery container exclusive for developer suction and superior in an efficiency of collecting wafting toner which maintains a high image quality.

The above problems can be solved by the following structures. Structure 1. An image forming apparatus, comprising: an image carrier to carry a toner image; a charging device to charge a surface of the image carrier; an image writing device to form a latent image of the surface of the image carrier which is charged by the charging device; a developing device to develop the latent image formed on the surface of the image carrier so as to form a toner image on the surface of the image carrier; a transfer device to transfer the toner image onto the image transfer member; a cleaning device to remove a toner remaining on the surface of the image carrier from the surface of the image carrier after the image is transferred by the transfer device; and a developer suction section, having; a recovery container to recover the toner removed by the cleaning device; a ventilation duct, including, a suction opening to suction air for collecting the wafting toner at a vicinity of the developing device; and an exhaust opening to exhaust air, and a toner collecting section to collect the wafting toner disposed in a middle of the ventilation duct, and a suction blower to suction air, wherein, the toner collecting section and the recovery container are connected via an opening and closing device, and a control section controls the opening and closing device to be closed while the suction blower is suctioning the air and to be opened after the blower is stopped so as to recover the toner collected by the toner collection section into the recovery container.

Structure 2. The image forming apparatus of structure 1, wherein the toner collection section is a cyclone type separation device.

DETAILED DESCRIPTION OF PREFERRED EMBODIMENT

An embodiment will be described with reference to the drawings. Incidentally, the present invention will be described on the basis of the embodiment without the present invention being limited thereto. Assertive descriptions of the embodiment related to the present invention indicate the best modes and do not restrict meanings of terms or technical scopes of the present invention.

(1) An image forming apparatus related to the present invention will be described with reference to FIG. 1.

Figure 1:
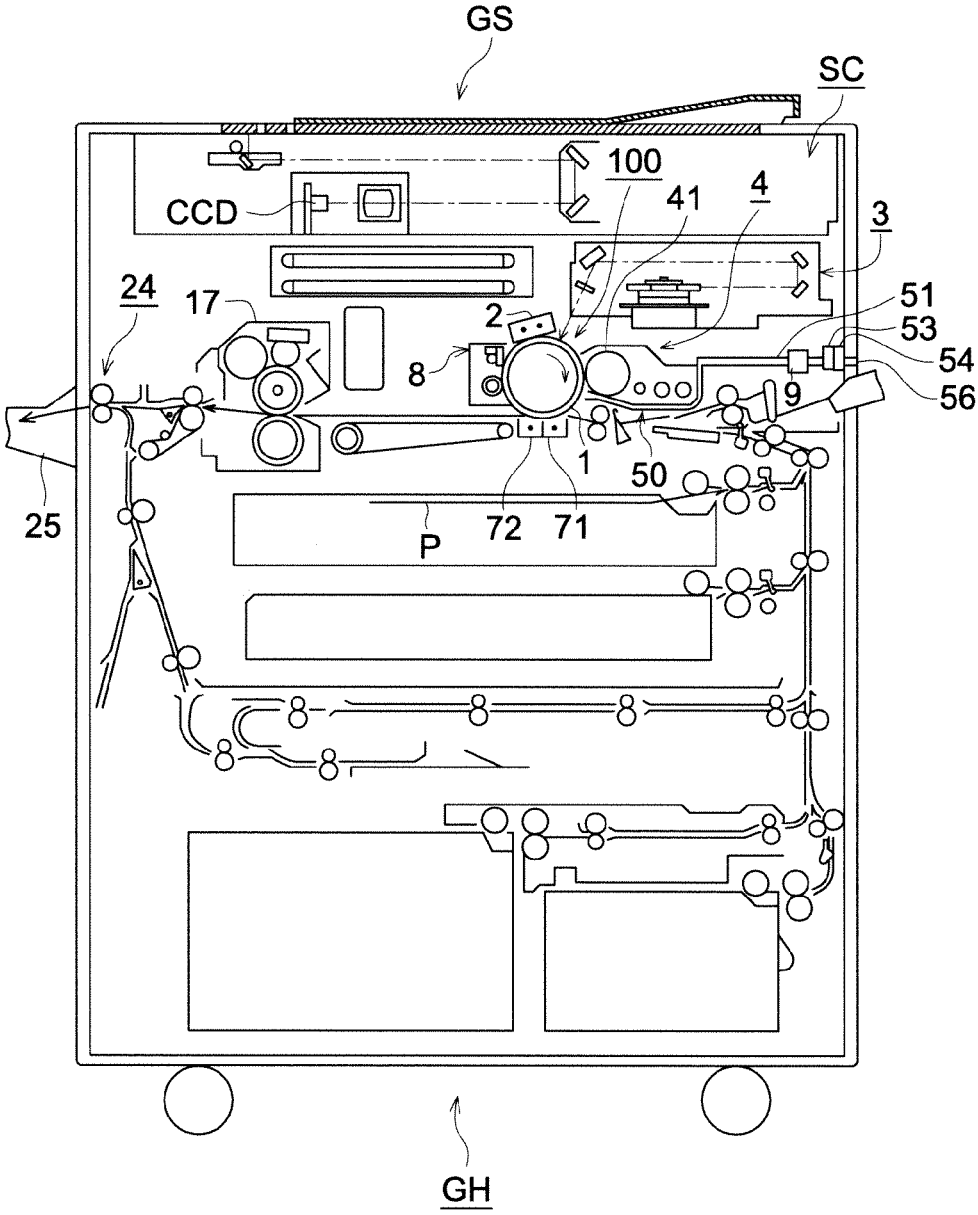
FIG. 1 is a cross-sectional configuration diagram of a relevant portion of an embodiment of an image forming apparatus related to the present invention.

According to FIG. 1, the image forming apparatus GS is configured with an image forming apparatus main body GH, and an image reading device SC disposed at an upper part of the image forming apparatus GH.

The image forming apparatus main body GH, provided with an image forming unit to form a toner image, transfers the toner image formed on an image carrier of the image forming unit onto a transfer member.

In FIG. 1, a document image placed on the image reading device SC, which is disposed at the upper part of the image forming apparatus main body GH, is exposed by scanning through an optical system and read by a line image sensor CCD, then converted to an analogue signal by photoelectric conversion via the line image sensor. The analogue signal is subject to analogue processing, A/D conversion, shading correction, image compression processing and so forth in an image processing section. After that an image data signal is sent to an exposure optical system 3 representing an image writing device.

Also, in FIG. 1, an imaging cartridge 100 for image forming representing a toner image forming device is disposed in an order shown by FIG. 1.

The imaging cartridge 100 is configured with a photoconductive drum 1 representing a image carrier, a charging device 2 representing a charging unit, an exposure optical system 3 representing a writing device, a developing device 4 to be described and a photoconductive member cleaning device 8 representing an image carrier cleaning unit.

The photoconductive drum 1 representing the image carrier is configured in a way that a photoconductive layer of an organic photo conductor (OPC) layer having a layer thickness (film thickness) of 20 to 40 μm is formed on an outer circumference of a cylindrical substrate which is formed by a metallic member such as aluminum having an outer diameter of, for example, 40 to 100 mm. The photoconductive drum 1 is rotated via an unillustrated drive source at a linier speed of 80 to 280 mm/s, preferably 220 mm/s, in a direction shown by an arrow while being grounded.

Figure 2:
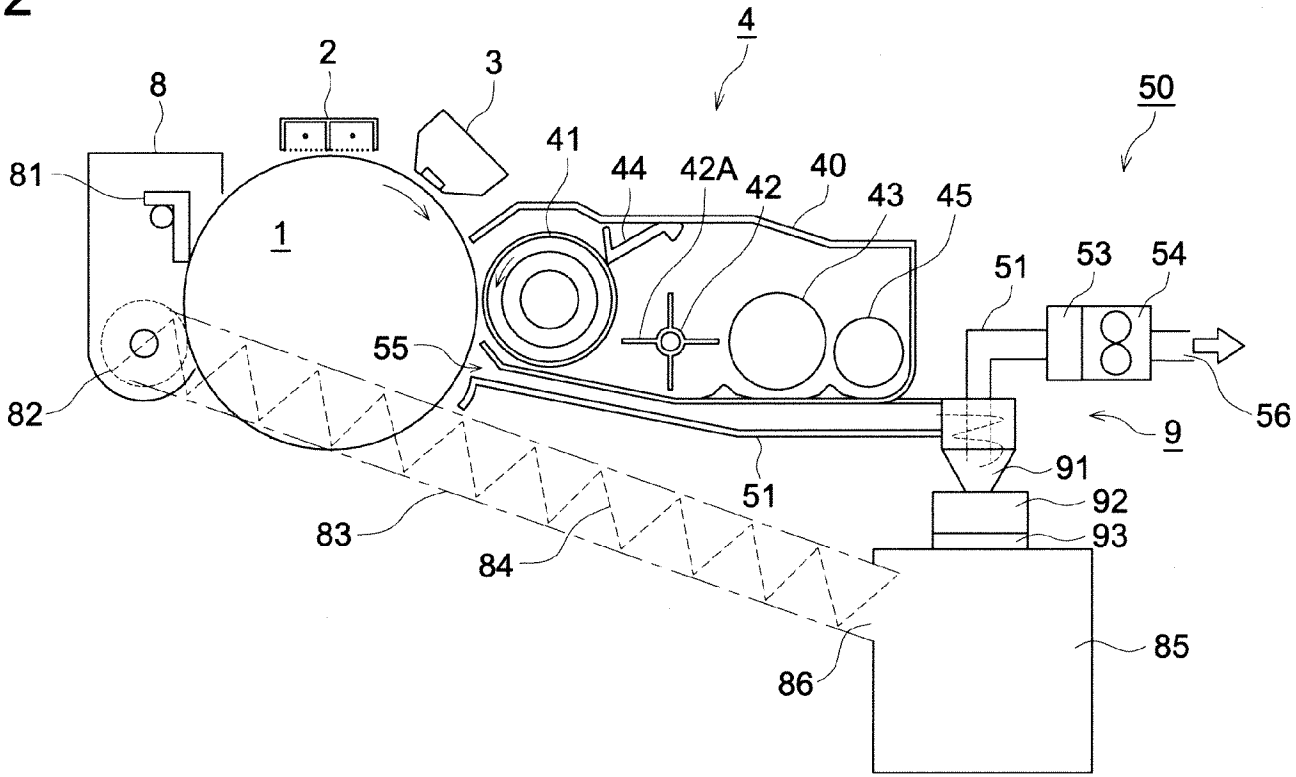
FIG. 2 is a cross-sectional view including a developer suction section related to the present invention.

At a periphery of the photoconductive drum 1, the charging device 2 representing a charging unit, the exposure optical system 3 representing the image writing device, and the developing device 4 representing the image forming section are disposed in an order of rotation direction of the photoconductive drum 1 shown by the arrow in FIG. 2.

The charging device 2 representing the charging unit is mounted to oppose and to be close to the photoconductive drum 1 in a direction perpendicular to a moving direction of the photoconductive drum 1 (a vertical direction with respect to the page in the figure). The charging device 2, provided with a discharging wire representing a corona discharging electrode to apply a predetermined voltage with respect to the organic photoconductor lay of the photoconductive drum 1, performs charging operation through corona discharging having the same polarity as that of the toner (negative charge in the present embodiment) so as to give an even voltage with respect to the photoconductive drum 1.

The exposure optical system 3 representing the image writing device operates a laser light beam emitted from an unillustrated semiconductor laser (LD) source in a main scanning direction by rotating a rotatable polygonal mirror (no symbol) so that the surface of the photoconductive drum 1 is scanned and exposed (image writing) by the laser light beam via a fθ lens (no symbol) and a refection mirror (no symbol) in accordance with an electric signal corresponding to an image signal and forms an electrostatic latent image corresponding to the document image on the photoconductive layer on the surface of the photoconductive drum 1.

The developing device 4 representing the developing device stores two-component developer including the toner charged in the same polarity as that of the charging polarity of the photoconductive drum and is provided with a developing roller 41 representing a developer carrier formed by an stainless steel or aluminum member in a shape of a cylinder having, for example, a thickness of 0.5 to 1 mm, and an outer diameter of 15 to 25 mm. The developing roller 41 maintains a predetermined gap between the photoconductive drum 1, for example 100 to 1000 μm via a contact roller (unillustrated) and rotates in the same direction as that of the photoconductive drum 1. At the time of developing, by applying a developing bias voltage having the same polarity as that of the toner, which is a direct current voltage or a voltage in which alternate current is superimposed onto a direct current, with respect to the developing roller 41, reverse transferring is carried out with respect to an exposing section on the photoconductive drum 1. As the developer used for reversal developing, a polymerized toner is use preferably. The toner wafting between the photoconductive drum 1 and each developing device 40 is suctioned by the section blower 54, representing a suction section disposed at the developer suction section 50, and after collected by the toner collection section 9 disposed in a middle of the ventilation duct 51, the toner is discharged outside the apparatus through an exhaust opening 56.

The transfer device 71 representing a transfer measure for the toner image provided with a corona discharging wire charges a transfer device side surface of a recording sheet P in an opposite polarity to the toner so as to transfer the toner image on the photoconductive drum 1 onto the recording sheet P. After transferring, the sheet P is separated from the surface of the photoconductive drum 1 via a separating device 72.

The image forming process will be described as follow.

When starting image recording, the photoconductive drum 1 is rotated by starting an unillustrated photoconductive member drive motor in a direction shown by the arrow and a voltage is given via the charging device 2. After that, the exposing optical system 3 performs exposure (writing) by a color signal, namely an electric signal corresponding to image data, so as to form an electrostatic latent image corresponding to an image on the photoconductive drum 1. The latent image is developed reversely so as to form a toner image formed on the photoconductive drum 1. The toner image formed on the photoconductive drum 1 is transferred onto the recording sheet P via the transfer device 71 representing a transfer measure.

The recording sheet P onto which the toner image is transferred is fixed by heat and pressure at a fixing nip section configured with a heating roller and a pressing roller of the fixing device 17 and pinched by the sheet ejection roller 24 to be placed on a sheet ejection tray 25 outside the apparatus.

(2) Next, the developer suction section 50 will be described with reference to FIG. 2.

FIG. 2 is a schematic cross-sectional view of the developer suction section 50, the developing device 4 and the photoconductive member cleaning device 8.

In the developing device 4, the developing roller 41 is disposed opposing the photoconductive surface of the photoconductive drum 1 having an outer diameter of, for example, 100 mm in parallel therewith.

The developing device 4 to store toner is provided with a developing roller 41 which rotates in same the direction (an arrow direction of FIG. 2) as a direction in which the developer moves along movement of the surface of the photoconductive drum 1 at a developing position while maintaining a predetermined gap between the circumferential surface of the photoconductive drum 1.

In the developing device 4, a numeral 40 denotes a housing representing a developer storing section to store a two-component developer having a toner and a carrier, a numeral 41 denotes a developing roller representing a developer carrying member having a magnet role (unillustrated) inside, a numeral 44 denotes a layer thickness restriction member configured with a magnetic material to restrict the developer layer thickness on the developing roller 41 to a predetermined amount, a numeral 42 denotes a conveyance and supply roller and numerals 43 and 45 denote a pair of agitation screws.

The developing roller 41 representing the developer conveyance member is configured with, for example, a non-magnetic member in a shape of a cylinder having an outer diameter of 8 to 60 mm using an aluminum or stainless steel member, and the developing roller 41 rotates in an anticlockwise direction with respect to the rotation (clockwise direction in FIG. 2) of the photoconductive drum 1 while maintaining a predetermined gap between the circumferential surface of the photoconductive drum 1 via unillustrated contact rollers disposed at both ends of the developing roller 41. If the outer diameter is 8 mm or less, it is impossible to from the magnet role (unillustrated) having at least five magnetic poles N1, S1, N2, S2 and N3 which are required for image forming. On the other hand, if the outer diameter of the developing roller exceeds 60 mm, the size of the developing device 4 increases. In the color printer (FIG. 1) having a plurality of the developing devices 4 in particular, a volume occupied by the developing device increases and the outer diameter of the photoconductive drum 1 increase. Thus the size of the image forming apparatus GS increases due to increase of the photoconductive drum 1 in size.

In the unillustrated magnet role included in the developing roller 41, for example, a plurality of magnetic poles N1, N2, N3, S1 and S2 are disposed alternately (unillustrated) and fixed co-axially with the developing roller 41 to form an electric field on the sleeve.

The layer thickness restriction member 44 configured with a magnetic stainless steel material in a shape of a bar or a plate is disposed to oppose a magnetic pole of N polarity of the unillustrated magnet roll having a predetermined gasp between the developing roller 41 so as to restrict the layer thickness of the two-component developer formed on the circumferential surface of the developing roller 41 stably and evenly. The present method using the magnetic layer thickness restriction member 44 is particularly superior in forming a thin layer of the developer on the surface of the developing roller 41.

The conveyance supply roller 42 conveys the developer scraped from the developing roller 41 to the agitation screw 43 and supply the developer agitated by the agitation screw 43 to the layer thickness restriction member 44. A numeral 42A disposed at the conveyance supply roller 42 denotes blade sections to convey the developer.

The agitation screws 43 and 45 to rotate in opposite directions each other in the same speed agitate and mix the toner and the carrier in the two-component developer evenly to be a predetermined proportion.

The toner replenished to the housing 40 via an unillustrated toner replenishing opening at an upper part of the housing 40 above the agitation screw 45 is agitated and mixed with the developer stored in the housing via the agitation screws 43 and 45 rotating in opposite directions each other in the same speed to be a developer having an even toner density, then the developer is conveyed to the layer thickness restriction member 44 via the conveyance supply roller 42 in rotation, and supplied onto the outer circumferential surface of the developing roller 41 as a layer having a predetermined thickness via the layer thickness restriction member. A residual developer after developing the latent image on the photoconductive drum 1 is scraped by the developing roller 41 and conveyed to the agitation screw 43 again via the conveyance supply roller 42. The electrostatic latent image on the photoconductive drum 1 is subject to reversal development through a non-contact developing method by applying a developing bias voltage in which a direct current bias voltage (DC) is superimposed to an alternate current bias voltage as needed.

As FIG. 2 shows, the developer suction section 50 related to the present invention is disposed adjacent to the developing device 4. The developing suction 50 is provided with a ventilation duct 51 and a suction opening 55 and an exhaust opening 56 for the wafting toner are provided at both ends of the ventilation duct 51 respectively.

Also, a cyclone separation device 90 representing an example of a toner collection section 9 is connected between the suction opening 55 and the exhaust opening 56 of the ventilation duct 51. At an upper part of the cyclone separation device 90, between the cyclone separation device 90 and the exhaust opening 56, the filter 53 and the suction blower to suctions the wafting toner which is connected with the exhaust opening are disposed.

The cyclone separation device 90, generally used and known to the public, spins an air flow containing the wafting toner coming form the suction opening 55 in an air trunk 91 in a shape of a circular cone so that the wafting toner is separated from the air flow using a centrifugal force which affects to the wafting toner. At a lower part of the air trunk 91 in the shape of the circular cone, a toner collecting container 92 is disposed to collect the separated toner. The air flow from which the toner has been separated is suctioned by the suction blower 54 and filtered by the filter 53 to collect a remaining wafting toner in the air flow to be exhausted from the exhaust opening 56.

The photoconductive member cleaning device 8 is configured with a cleaning blade 81, a toner guide roller 82, a recovery toner guide tube 83, a toner conveyance screw 84 and a toner recovery container 85.

The transfer remaining toner adhering on the surface of the photoconductive drum 1 is removed from the surface of the photoconductive drum 1 by the cleaning blade 81 and guided to the recovery toner guide tube 83 side via the toner guide roller 82. The toner reached at the recovery toner guide tube 83 is guided by the toner conveyance screw 84 rotating in the recovery toner guide tube 83 and lead to an opening section 86 of the toner recovery container 85 to be recovered.

At an upper part of the toner recovery container 85, the toner collecting container 92 of the cyclone separation device 90 is disposed, and the toner collection container 92 and the toner recovery container 85 are connected each other via the opening and closing device 93. The opening and closing device 93 is controlled by the control device 110 to control the opening and closing device to be an open state or a close state.

The control device 110 control the opening and closing device 93 to be the closed state when the suction blower 54 of the developer suction section 50 is suctioning air, and after the suction blower 54 stops the control device 110 controls the opening and closing device to be the open state so that the toner collected by the toner collecting container 92 is recovered by the toner recovery container 85.

The opening and closing device 93 of the present embodiment employs a solenoid to move an opening and closing plate biased by a spring. The opening and closing plate is closed when the solenoid is energized and is closed by a bias force of the spring when the solenoid is not energized. The opening and closing device 93 can be one to switch the toner collection container 92 and the toner recovery container 85 between a communicating state and a non-communicating state via the control device 110 without being limited to the solenoid.

Figure 3:
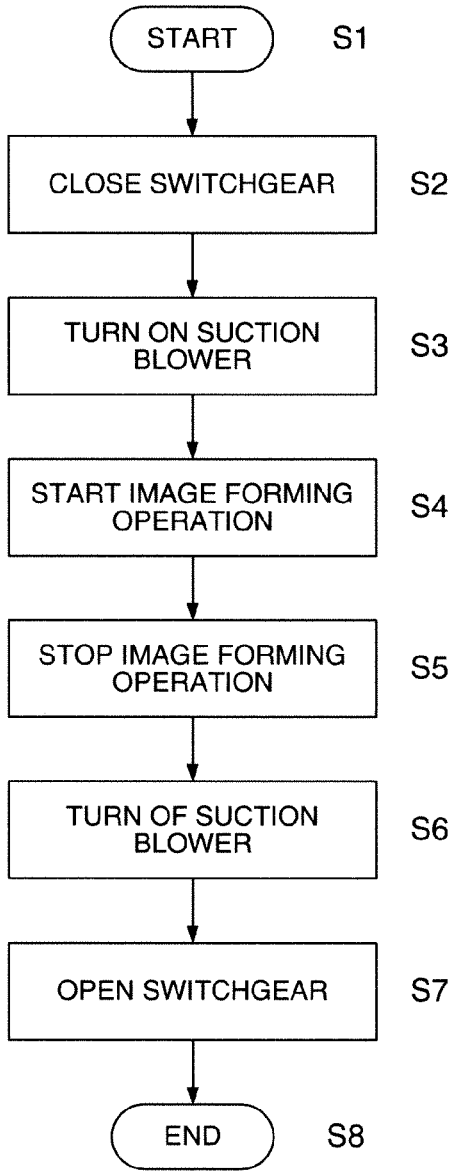
FIG. 3 is a flow chart to describe operation of an opening and closing device related to the present invention.

FIG. 3 is a flow chart of operation control of the opening and closing device 93.

When turning on a start switch of printing of the control device 110 (CPU) to operation of each section of the image forming apparatus (S1), the opening and closing device 93 is closed (S2) by the control device 110 (CPU) and the suction blower 54 is turned on (air suction state) (S3). Next, image forming operation starts (S4) and the latent image on the photoconductive drum 1 is developed by the developing device 4 then an image is formed on the recording sheet. When the image forming operation stops (S5), the suction blower 54 is turned off (suction blower 54 stops) (S6). Thereafter, the opening and closing device 93 becomes the open state via the control device 110 (CPU) (S7). When the opening and closing device 93 becomes the open state, the toner collected in the toner collecting container 92 falls onto the toner recovery container 85 to be recovered.

As above, since the toner collected by the developer suction section 50 is recovered by a recovery container 85 which recovers the toner removed by the photoconductive member cleaning device 8, a recovery container solely for developer suction is not necessary to be provided, which prevents the apparatus from increasing in size and number of maintenance parts can be reduced.

Also, when air is suctioned while operating the suction blower 54, by closing the opening and closing device 93, the air suctioned by the suction blower 54 via the suction opening 55 can be suctioned steady. Namely, air suctioning from the toner recovery container 85 caused by opening the opening and closing device 93 while the suction blower 54 is operating, can be obviated thus air from the suction opening 55 can be suction stead. Whereby, the wafting toner from the developing device 4 can be removed steady. As a result, deterioration of the image caused by the wafting toner adhering on the photoconductive drum 1 and deterioration of the image caused by the toner accumulating in the image forming apparatus and falling on the sheet to be printed, as well as defective charging and defective exposing caused by the toner adhering on the charging device 2 and exposure optical system 3 are obviated.

The present embodiment using the cyclone separation device 90 for the toner collecting section of the developer suction section 50 is preferable from a view point to collect the wafting toner efficiently without the collecting device for the wafting toner being limited thereto. It can be any recovering device which recovers collected the toner wafting in the conveyance pathway into the toner recovery container 85 which recovers the toner collected by the cleaning device.

Also, in the present embodiment, the toner in the toner collection container 92 collected by the developer suction section 50 is recovered into the toner recovery container 85, however the toner can be recovered to the toner recovery container 85 in a way that by connecting the toner collecting container 92 and the recovery toner guide tube 83 via the opening and closing device 92, when the opening and closing device 93 is opened, the toner falls into the recovery toner guide tube 83 and the toner is recovered into the toner recovery container 85 via a recovery toner conveyance screw 84.

Figure 4:
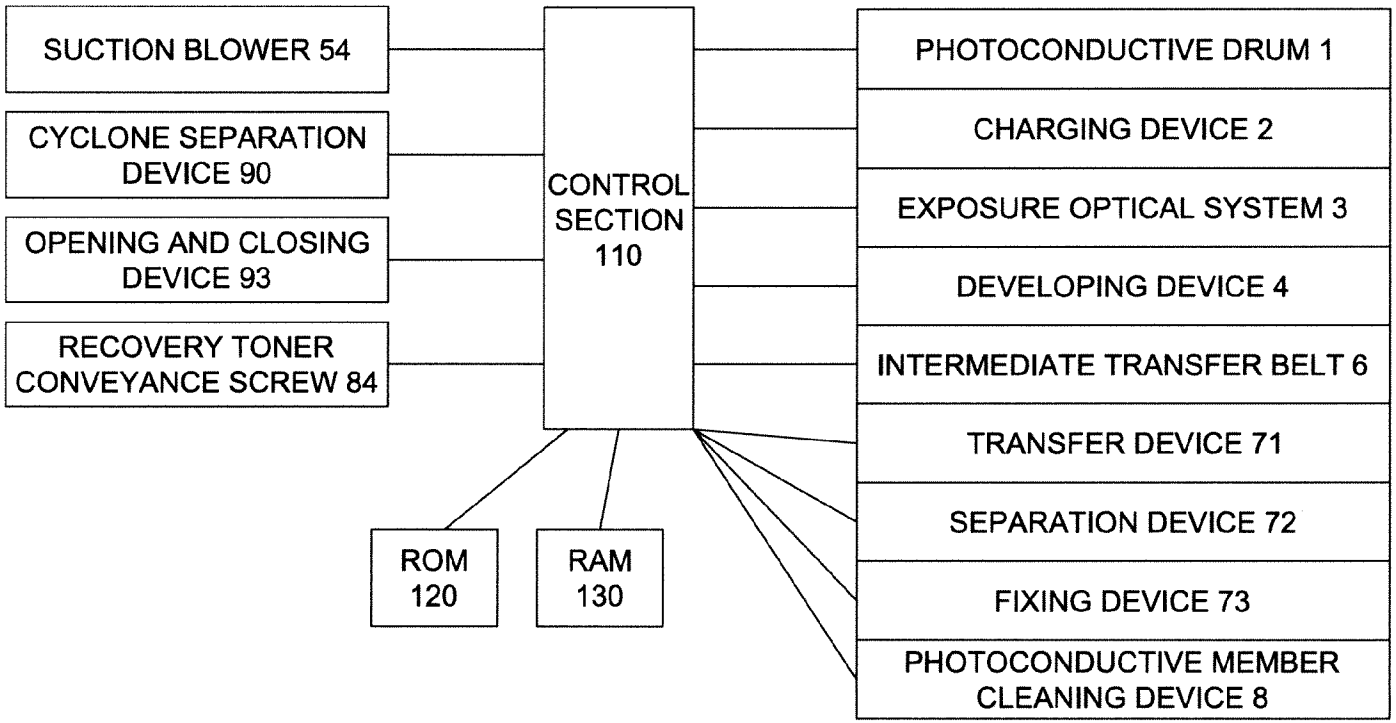
FIG. 4 is a block diagram describing a control section related to the present invention.

FIG. 4 is to describe the control section related to the embodiment and a CPU is used as the control section 110 which controls operations of the photoconductive drum 1, charging device 2, exposure optical system 3, developing device 4, intermediate transfer belt 6, transfer device 71, separation device 72, fixing device 17, photoconductive member cleaning device 8, suction blower 54, toner collection diction 9, opening and closing device 93, toner recovery conveyance screw 84. The control is configured using a program stored in a ROM 120 and data temporally stored in a RAM 130. The control section 11 controls the opening and closing device 93 to be in an open state and a close state described in the foregoing.

As above, in the description of the above image forming apparatus related to the present embodiment, while an image forming apparatus for monochrome image is described, the present invention includes an image forming apparatus for color image having a plurality of imaging cartridges.

The configuration of the present embodiment as above prevents each structural member and the transfer medium to be printed from taint caused by the wafting toner wafting at a vicinity of the developing device 4 and inside the image forming apparatus GS. Also, since the toner recovering container is shared, the image forming apparatus can be reduced in size and in addition, the number of maintenance parts can be reduced. Further, by disposing the toner collection section to collect the toner in the middle of the ventilation duct 51, the most of the wafting toner is collected, thereafter since the air after collecting the wafting toner flows through the filter 53, and since the toner collected by the collecting section is recovered into the recovery container while the image forming operation is halted, an amount of the wafting toner captured by the filter 53 reduces drastically, then clogging of the filter is eased and replacing period of the filter is extended. Further more, continuous operation becomes possible without replacing the toner collection container eve if it is small, and the replacing frequency of the recovery container is lowered which enhances operation efficiency of the image forming apparatus.

According to the present embodiment, in the image forming apparatus having the developer suction section, the toner collection section of the developer suction section and the recovery container are connected via the opening and closing device, and the control device 110 controls the opening and closing device to close the opening and closing device when the suction blower is suctioning air and to open the opening and closing device so that the recovery container recovers the toner collected by the toner collection section after the suction blower is stopped. Whereby, since the toner collected by the developer suction section can be recovered into the recovery container for the toner which is removed by the cleaning device, the recovery container exclusive for the developer suction section is not necessary. Thus the compact image forming apparatus capable of maintaining a high image quality and superior in an efficiency of collecting wafting toner can be provided.

What is claimed is:

1. An image forming apparatus, comprising:

an image carrier;

a developing device to develop the latent image formed on the surface of the image carrier so as to form a toner image on the surface of the image carrier;

a transfer device to transfer the toner image onto the image transfer member;

a cleaning device to remove a toner remaining on the surface of the image carrier from the surface of the image carrier after the image is transferred by the transfer device; and a developer suction section, having;

a recovery container to recover the toner removed by the cleaning device;

a ventilation duct, including, a suction opening to suction air for collecting the wafting toner at a vicinity of the developing device; and an exhaust opening to exhaust air, a toner collecting section to collect the wafting toner disposed in a middle of the ventilation duct, a suction section to suction air, and an opening and closing device to connect the toner collection section and the recovery container, and a control section to control the opening and closing device so as to close while the suction blower is suctioning the air and to open after the suction section is stopped.

2. The image forming apparatus of claim 1, wherein the toner collection section is a cyclone type separation device.

3. The image forming apparatus of claim 1, further comprising a guide section to lead the collected toner by the cleaning device to the recovery container.

4. The image forming apparatus of claim 1, further comprising a filter to collect the toner between the cyclone type separation device and the suction section.

5. The image forming apparatus of claim 1, wherein the recovery container is disposed vertically under the cyclone type separation device.

6. The image forming apparatus of claim 1, wherein the control device closes the opening and closing device after instructing a print start.

7. The image forming apparatus of claim 1, wherein the control section starts to operate of the suction section after the opening and closing device is closed.

8. The image forming apparatus of claim 1, wherein the control section stops to operate the suction section after an image forming operation is stopped.

9. The image forming apparatus of claim 1, wherein the control device opens the opening and closing device after the suction section stops to operate.

10. An image forming apparatus, comprising:

an image carrier to carry a toner image;

a charging device to charge a surface of the image carrier;

an image writing device to form a latent image of the surface of the image carrier which is charged by the charging device;

a developing device to develop the latent image formed on the surface of the image carrier so as to form a toner image on the surface of the image carrier;

a transfer device to transfer the toner image onto the image transfer member;

a cleaning device to remove a toner remaining on the surface of the image carrier from the surface of the image carrier after the image is transferred by the transfer device; and a developer suction section, having;

a recovery container to recover the toner removed by the cleaning device;

a ventilation duct, including, a suction opening to suction air for collecting the wafting toner at a vicinity of the developing device; and an exhaust opening to exhaust air, and a toner collecting section to collect the wafting toner disposed in a middle of the ventilation duct, and a suction section to suction air, an opening and closing device to connect the toner collection section and the recovery container, and a control section to control the opening and closing device so as to close while the suction blower is suctioning the air and to open after the suction section is stopped so that the toner collected by the collection section is recovered into the recovery container.

* * * * *